United States Patent [19]

Gilovich et al.

[11] 4,186,977

[45] Feb. 5, 1980

[54] SELF-LOCKING DEPOSITORY CONTAINER

[75] Inventors: Paul A. Gilovich, Saratoga; John J. Lynott, Los Gatos, both of Calif.

[73] Assignee: International Business Machines Corporation, Armonk, N.Y.

[21] Appl. No.: 952,436

[22] Filed: Oct. 18, 1978

[51] Int. Cl.[2] ..... E05B 65/46; G07B 15/00

[52] U.S. Cl. ..... 312/215; 312/219; 312/222; 232/15; 109/52

[58] Field of Search ..... 312/215, 216, 217, 218, 312/219, 220, 221, 222, 211, 292, 107.5; 109/52, 66; 232/1 R, 15

[56] References Cited

U.S. PATENT DOCUMENTS

| | | | |
|---|---|---|---|
| 1,065,146 | 6/1913 | Kohler | 232/15 |
| 1,105,621 | 8/1914 | Cook | 232/15 |
| 2,613,871 | 10/1952 | Broussard et al. | 232/1 R |
| 2,973,139 | 2/1961 | Leone et al. | 232/15 |
| 3,083,896 | 4/1963 | Cairelli et al. | 109/52 |
| 3,175,759 | 3/1965 | Teale et al. | 232/1 R |
| 3,455,503 | 7/1969 | Coffield | 232/15 |
| 3,455,503 | 7/1969 | Coffield | 232/16 |
| 3,674,360 | 7/1972 | Ratner | 312/215 |
| 3,773,252 | 11/1973 | Jensen | 232/15 |
| 3,773,252 | 11/1973 | Jensen | 232/1 R |
| 3,948,376 | 4/1976 | Roman | 232/15 |
| 4,010,989 | 3/1977 | Klug | 312/215 |
| 4,066,307 | 1/1978 | Barding | 312/215 |

*Primary Examiner*—Victor N. Sakran

*Attorney, Agent, or Firm*—Henry E. Otto, Jr.

[57] ABSTRACT

Means and method for securing, in a predetermined location within a housing of a substantially stationary safe or the like and controlling access to the interior of, a portable currency or document depository having a slidable door that is normally locked closed. After insertion of the depository at said location, a barrier arm is rotated down to block removal of the depository and rotate a member into operative engagement with the door. A key irremovably carried by said arm is then insertable to unlock the door. The door is now opened by moving the member translationally one way, allowing access to the interior of the depository. The member must be moved the opposite way to close the door, and the door must be relocked by the key before the key can be withdrawn and the barrier arm rotated up to permit removal of the now relocked depository.

9 Claims, 3 Drawing Figures

SELF-LOCKING DEPOSITORY CONTAINER

TECHNICAL FIELD

This invention relates to an apparatus and method for restricting access to a portable depository.

One object of this invention is to provide a simple, effective and improved apparatus and method for securing a portable currency or valuable-document depository in a predetermined location in a housing of a substantially stationary device and so controlling access to the interior of the depository that the depository, which is locked upon entering the device, is opened for access only when inaccessibly and irremovably secured at said location within said device.

Another object is to insure that the depository must be relocked closed before it can be removed from the housing.

BACKGROUND ART

Various methods and apparatus have heretofore been proposed to minimize the likelihood of theft or embezzlement of currency or other valuable items from portable depositories.

U.S. Pat. No. 3,773,252 discloses a portable depository employing one key to close an opening in a detachable lid in the depository, and a second key to permit removal of the lid from the depository to provide access to the interior. Neither key is associated with a member that (a) controls insertion/removal of the depository into/from the housing of the vending apparatus within which the depository is removably housed, or (b) permits the key to be inserted into the lock only when the member is in a position in which it prevents removal of the depository from the vending apparatus.

U.S. Pat. No. 3,455,503 discloses a portable coin container that comprises a lock having a latching portion that normally holds a slidable cover in fixed position over an opening to prevent the contents of an inner container from exiting via an aperture in an enveloping housing. This housing carries a shielded key that is attached by way of a rod to another cover that is retractable to enable insertion/removal of the container into/from the housing.

IBM Technical Disclosure Bulletin, Vol. 15, No. 5, published in October 1972, discloses (at pp. 1146–1148) a cash bag having a slidable door that automatically closes an aperture when the bag is removed from a safe or the like.

BRIEF DESCRIPTION OF DRAWINGS

In the accompanying drawings forming a material part of this disclosure.

DISCLOSURE OF INVENTION

For further comprehension of the invention, and of the objects and advantages thereof, reference will be had to the following description and accompanying drawings, and to the appended claims in which the various novel features of the invention are more particularly set forth.

Figure 1:
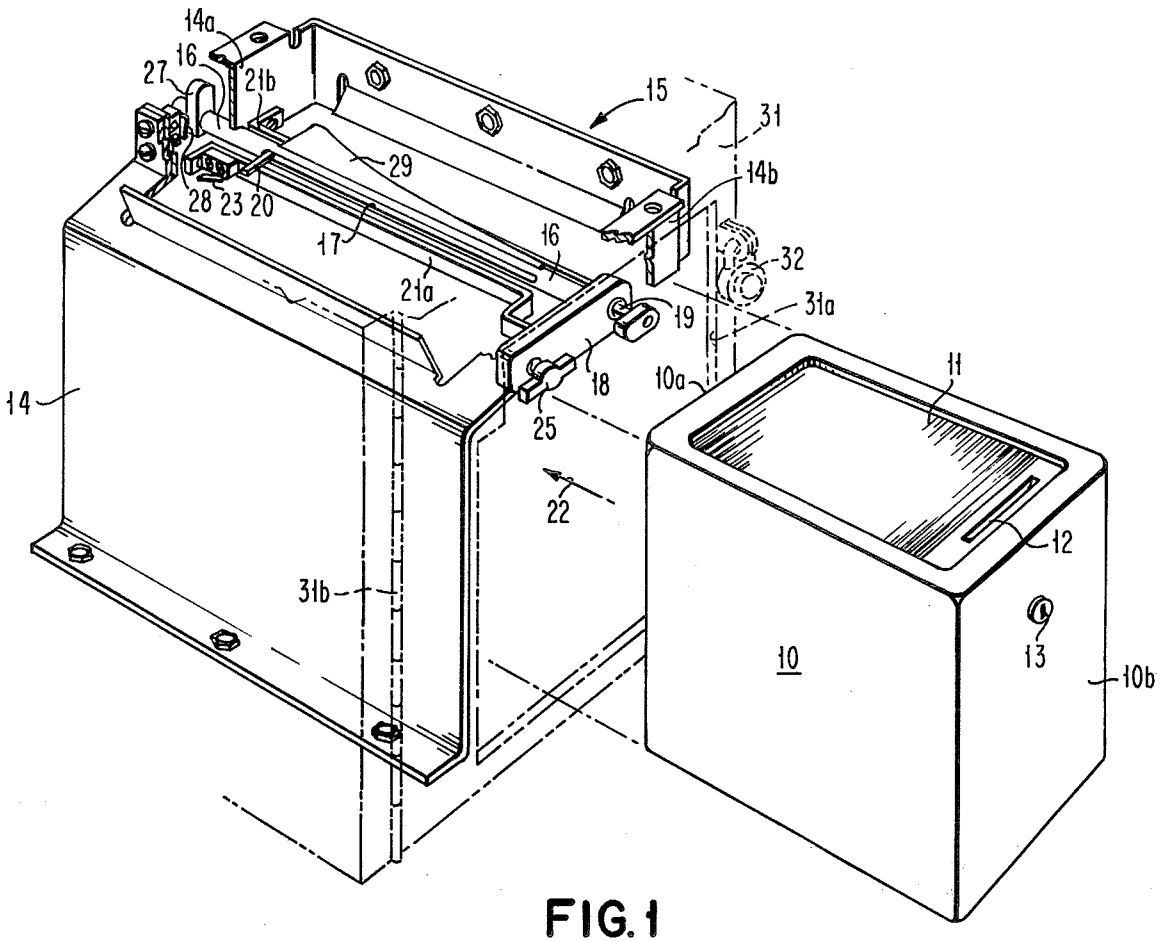
FIG. 1 is an isometric view of an apparatus embodying the invention, the apparatus being depicted in one position in which a barrier arm is in an unblocking position and the apparatus is conditioned to permit insertion of a portable depository within a housing.

The apparatus embodying the invention controls access to the interior of a portable depository 10 for currency or valuable documents. As illustrated in FIG. 1, this depository preferably comprises a hollow box-like structure having a tambour door (that in the manner of a roll top desk front) is movable within a confined, non-rectilinear path. Adjacent its one end, door 11 has a recess or notch 12 which, when engaged, permits the door to be opened by displacing it toward and down, inside and along one vertical side 10*a* of the depository. Depository 10 also comprises a lock 13 in the vertical side 10*b*, which is opposite side 10*a*. Door 11 is normally locked closed to prevent theft of the contents. However, door 11 is adapted to be unlocked and opened in the manner now to be explained when depository 10 is inaccessibly and irremovably secured at a predetermined location within a substantially stationary housing 14 of an apparatus 15 embodying the invention.

As illustrated in FIG. 1, apparatus 15 comprises a tube 16 rotatably journaled at opposite ends within bearings (not shown) in end portions 14*a, b* of housing 14, but not movable axially. Tube 16 has a through slot 17 extending axially a prescribed length. Adjacent one end of tube 16 and keyed thereto is a radially extending barrier arm 18.

Slidably mounted within tube 16 is a rod 19 having a pin 20 that projects radially through slot 17. Pin 20 normally rests on the upper edge of a retainer means that comprises two flat strips 21*a, b* uniformly spaced to provide a vertical channel therebetween. With pin 20 resting on the upper edges of retainer strips 21*a, b* tube 16 and rod 19 will be maintained in the position in which they are shown in FIG. 1, by virtue of the pin-in-slot connection between the tube and rod and pin 20. With tube 16 thus positioned, the barrier arm 18 secured to tube 16 will extend generally horizontally. Thus, the apparatus as illustrated in FIG. 1 is conditioned to enable depository 10 to be inserted in the direction of arrow 22 into housing 14 via a cut-out area 31*a* in a door 31. Door 31 is hinged along edge 31*b* and is normally maintained locked closed by a padlock 32, as shown. When fully inserted, the upper edge of depository 10 will contact and make a microswitch 23. Switch 23 senses that the depository is properly inserted in the appropriate predetermined location within the housing.

Figure 2:
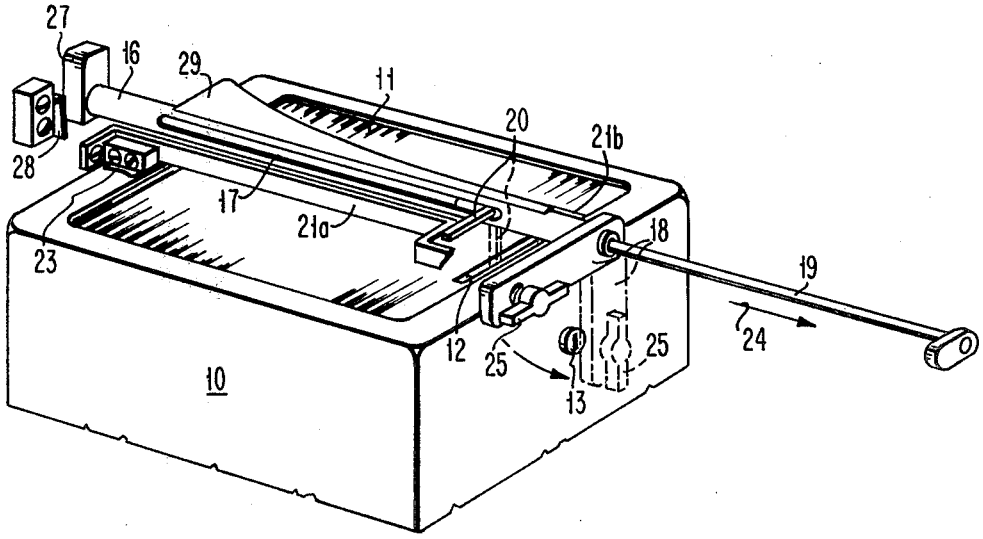
FIG. 2 is a fragmentary perspective view, to somewhat enlarged scale, showing the apparatus conditioned to enable rotation of the barrier arm to a blocking position (indicated in phantom) following insertion of the depository within the housing.

Assume now that depository 10 has been inserted within housing 14, and that microswitch 23 is made. Access to the interior of the depository is achieved in the following manner. Referring now to FIG. 2, rod 19 is withdrawn from tube 16 in the direction of arrow 24 until pin 20 is withdrawn from sliding engagement with retainer strips 21*a, b*, as shown in solid lines in FIG. 2. Barrier arm 18 is now rotated counterclockwise ninety degrees to the position in which it is shown in dotted lines. Through the pin-in-slot connection 16, 20, 17, 19, rotation of tube 16 by arm 18 correspondingly rotates pin 20 into locking engagement with notch 12 in door 11. A key 25, carried by arm 18, is now aligned with lock 13. The key 25 is permanently affixed to arm 18 and is normally spring biased in the direction of arrow 24 to a retracted position. Key 25 is now inserted, against the spring bias, into the aligned lock 13 and then rotated counterclockwise to unlock door 11. Key 25 is of the type that cannot be disengaged from lock 13 except when door 11 is locked.

Figure 3:
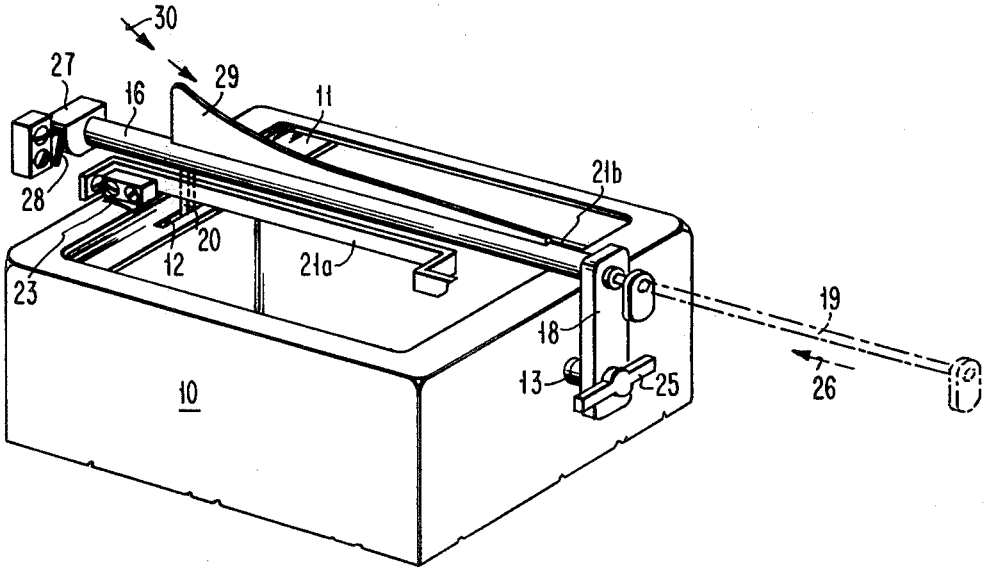
FIG. 3 is a fragmentary perspective view similar to FIG. 2, except showing the apparatus conditioned to provide access to the interior of the depository.

Referring to FIG. 3, door 11 is now opened in the following manner. Rod 19 is reinserted within tube 16. As rod 19 moves in the direction of arrow 26 from the position in which it is shown in dotted lines to that in which it is shown in solid lines, door 11 is opened by engagement of pin 20 with notch 12. Meanwhile, pin 20 is kept within the channel between retainer strips 21*a, b,* assuring that the pin cannot be disengaged from the door and, more importantly, that barrier arm 18 cannot be rotated in either direction from its depository removal blocking position to unblocking position. Note that the cut-out area 31*a* is only large enough to permit insertion of the depository 10 with slight clearance. Hence, access to the interior of the now-opened depository is effectively masked from the operator.

Note that the apparatus, which may be a safe or the like, comprises an outer door (not shown) that is adapted to be closed after the depository 10 is inserted. This outer door cannot be closed unless rod 19 is fully inserted. Also, with the apparatus conditioned as shown in FIG. 3, in which barrier arm 18 is in its blocking position, a cam 27 attached to tube 16 engages and makes a microswitch 28. Microswitches 23 and 28 and a microswitch (not shown) sensing closure of the outer safe door are preferably connected in series in a circuit (not shown) such that all three must be made to provide power to feed means (not shown) by which currency, envelopes, or valuable documents are driven into depository 10.

An axially extending deflector fin 29 preferably projects radially from tube 16 to deflect envelopes, currency or other documents to either side of the tube and into the now opened depository 10 when they are advanced generally in the direction of arrow 30, while the aforementioned feed means is enabled.

Assume now that depository 10 has been filled, or for some other reason is to be removed from the apparatus. The apparatus ensures that, in the following manner, door 11 must be closed and locked before such removal can take place. More specifically, as viewed in FIG. 3, rod 19 is withdrawn from tube 16 to the position in which it is shown in dotted lines. This concurrently causes door 11 to be closed by pin 20. Key 25 is now rotated clockwise to lock door 11 closed; whereupon the key will automatically be retracted from the lock by the spring bias. With key 25 now disengaged from lock 13, arm 18 can now be rotated clockwise from the position in which it is shown in dotted lines in FIG. 2 to the position in which it is shown in solid lines. This rotation of arm 18 operatively causes pin 20 to be rotated out of the channel between strips 21*a, b* and to a position just above the upper edge of said strips. As rod 19 is now reinserted into tube 16, it will advance pin in sliding engagement with retainer strips 21*a, b* and thus ensure that arm 18 will be retained in its horizontal, unblocking position. Depository 10 may now be withdrawn from the housing 14 to the position shown in FIG. 1 by translational movement in a direction opposite to that of arrow 22.

It will thus be seen that whenever the door of the safe or other apparatus that receives the depository is open, the door 11 of the depository is locked closed; and that the door is opened only when the door of the safe is closed; and the door of the safe cannot be reopened and the depository withdrawn until the door 11 has been locked closed.

While the invention has been particularly shown and described with reference to a preferred embodiment thereof, it will be understood by those skilled in the art that various changes in form and detail may be made therein without departing from the spirit, scope and teaching of the invention. Accordingly, the apparatus and method herein disclosed are to be considered merely as illustrative and the invention is to be limited only as specified in the claims.

What is claimed is:

1. Apparatus for securing, within a substantially stationary housing and controlling access to the interior of, a portable depository having an access member that is normally locked closed, said apparatus comprising:

key means insertable into the depository for unlocking the member; and two means supported by the housing and movable axially and rotationally relative to each other with certain restraints, one of said means providing a barrier arm that carries said key means and is rotatable to a blocking position to prevent removal of the depository when the other of said means is withdrawn axially at least a predetermined distance relative to said one means, said other means being rotated by said one means into operative engagement with the member to enable said member to be moved to an access-providing position following unlocking of the member by said key means and in response to reinsertion of said other means axially into said one means.

2. Apparatus according to claim 1, wherein said one means and other means are interconnected by a pin-in-slot connection.

3. Apparatus for securing, in a predetermined location within a substantially stationary housing and controlling access to the interior of, a portable depository having a member that is normally locked closed, said apparatus comprising:

barrier means supported by the housing and rotatable between one position in which it permits insertion/removal of the depository into/from the housings, and another position in which it prevents such insertion/removal;

key means secured to said barrier means and insertable into the depository for unlocking the member to permit access to the interior of the depository only when said barrier means is in said other position;

means movable translationally and rotationally relative to said barrier means; and means for selectively retaining the last-introduced means in one or the other of two rotative positions, in one of which it can move translationally one way and the opposite way for moving the member to access-providing and access-denying positions, respectively, and in another of which it is ineffective to do so.

4. Apparatus according to claim 3, including sensing means for sensing when said barrier means is in said other position to preclude operation of the apparatus unless said barrier means is in said other position.

5. Apparatus for receiving a portable depository having a slidable door that is normally locked closed, said apparatus comprising:

housing means defining a predetermined location for receiving the depository;

means rotatably supported by said housing means and including a tube with a longitudinal slot, a barrier arm extending transversely from said tube, and a key carried by said arm;

means including a rod slidably mounted within said tube, and a pin projecting from said rod and through said slot; and retainer means normally engaged by said pin for maintaining said arm in one position in which it permits movement of the depository into and from said location, said pin when withdrawn relative to said tube and past said retainer means permitting said arm to be rotated to another position in which it prevents removal of the depository from said location and enables insertion of the key in the lock and rotation of the key to a door-unlocking position.

6. Apparatus accoring to claim 5, wherein said retainer means is effective upon rotation of said arm to said other position to maintain said pin engaged with the door to cause the door to be moved to an open position by said pin responsively to reinsertion of said rod into said tube.

7. Apparatus according to claim 6, including deflector means projecting from said tube for deflecting items into the depository through the opened door when said arm is in said other position.

8. A method of insuring access to a normally locked depository only while it is irremovably and inaccessibly secured within a stationary housing, said method comprising the steps of:

inserting the depository in the housing while a barrier element which carries a key is held in one position out of contact with the depository;

rotating the barrier element to another position in which it concurrently prevents removal of the depository from the housing and aligns the key with a lock in the depository and rotates a member into engagement with the depository;

unlocking the depository with the key; and moving said member translationally one way to provide access to the interior of the unlocked depository, while removal of the depository from the housing is prevented by said barrier element.

9. The method according to claim 8, including the further steps of:

moving said member translationally the opposite way to terminate access to the interior of the unlocked depository;

relocking the depository with the key and withdrawing the key; and returning said barrier element to its said one position to enable removal of the now locked depository.

* * * * *